US005280840A

United States Patent [19]

Terpening

[11] Patent Number: 5,280,840

[45] Date of Patent: Jan. 25, 1994

[54] CARD DISPLAY ARRANGEMENT

[76] Inventor: Harold R. Terpening, 405 N. Lincoln, Mankato, Kans. 66956

[21] Appl. No.: 44,795

[22] Filed: Apr. 12, 1993

[51] Int. Cl.[5] ..... A47F 5/00

[52] U.S. Cl. ..... 211/165; 40/124; 211/169

[58] Field of Search ..... 211/41, 47, 163, 165, 211/169; 40/124, 124.2

[56] References Cited

U.S. PATENT DOCUMENTS

| | | | |
|---|---|---|---|
| 764,121 | 7/1904 | Guilford | 40/124.2 |
| 832,601 | 10/1906 | Fisk | 211/169 X |
| 3,661,273 | 5/1972 | Crosslen | 211/169 |
| 3,924,749 | 12/1975 | Weston | 211/169 X |
| 3,960,273 | 6/1976 | Weston | 211/169 X |
| 4,270,290 | 6/1981 | Eckert | 211/169 X |
| 5,160,050 | 11/1992 | Russo | 211/169 X |

*Primary Examiner*—Robert W. Gibson, Jr.
*Attorney, Agent, or Firm*—Leon Gilden

[57] ABSTRACT

A support rack is arranged to include a base having a shaft mounted fixedly and orthogonally relative to the base rotatably mounting a tubular housing having first and second flanges, wherein the first and second flanges are arranged to pivotally mount U-shaped frameworks to position and secure baseball cards and the like for ease of viewing and access. Each of the U-shaped frames is arranged to include a first and second U-shaped channel leg in facing relationship relative to one another having an intermediate web permitting positioning of cards between the first and second U-shaped channel legs on opposed sides of the intermediate web for display. A further configuration of the invention is arranged to include an illumination structure to direct illumination onto the card structure mounted within the U-shaped frames.

3 Claims, 4 Drawing Sheets

CARD DISPLAY ARRANGEMENT

BACKGROUND OF THE INVENTION

1. Field of the Invention

The field of invention relates to card display structure, and more specifically pertains to a new and improved card display arrangement wherein the same is arranged to pivotally mount a plurality of card members for ease of viewing and access.

2. Description of the Prior Art

Card display apparatus of various types have been indicated in the prior art and exemplified by the U.S. Pat. Nos. 4,912,866; 4,930,627; 5,038,927; and 4,102,070.

The instant invention is addressed to the display of sporting event cards that have developed into popularity and collectability and to this end, the present invention substantially fulfills this need.

SUMMARY OF THE INVENTION

In view of the foregoing disadvantages inherent in the known types of card display apparatus now present in the prior art, the present invention provides a card display arrangement wherein the same is directed to the rotatable mounting of sporting event cards within individual U-shaped frames. As such, the general purpose of the present invention, which will be described subsequently in greater detail, is to provide a new and improved card display arrangement which has all the advantages of the prior art card display apparatus and none of the disadvantages.

To attain this, the present invention provides a support rack arranged to include a base having a shaft mounted fixedly and orthogonally relative to the base rotatably mounting a tubular housing having first and second flanges, wherein the first and second flanges are arranged to pivotally mount U-shaped frameworks to position and secure baseball cards and the like for ease of viewing and acess. Each of the U-shaped frames is arranged to include a first and second U-shaped channel leg in facing relationship relative to one another having an intermediate web permitting positioning of cards between the first and second U-shaped channel legs on opposed sides of the intermediate web for display. A further configuration of the invention is arranged to include an illumination structure to direct illumination onto the card structure mounted within the U-shaped frames.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved card display arrangement which has all the advantages of the prior art card display apparatus and none of the disadvantages.

It is another object of the present invention to provide a new and improved card display arrangement which may be easily and efficiently manufactured and marketed.

It is a further object of the present invention to provide a new and improved card display arrangement which is of a durable and reliable construction.

An even further object of the present invention is to provide a new and improved card display arrangement which is susceptible of a low cost of manufacture with regard to both materials and labor, and which accordingly is then susceptible of low prices of sale to the consuming public, thereby making such card display arrangements economically available to the buying public.

Still yet another object of the present invention is to provide a new and improved card display arrangement which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
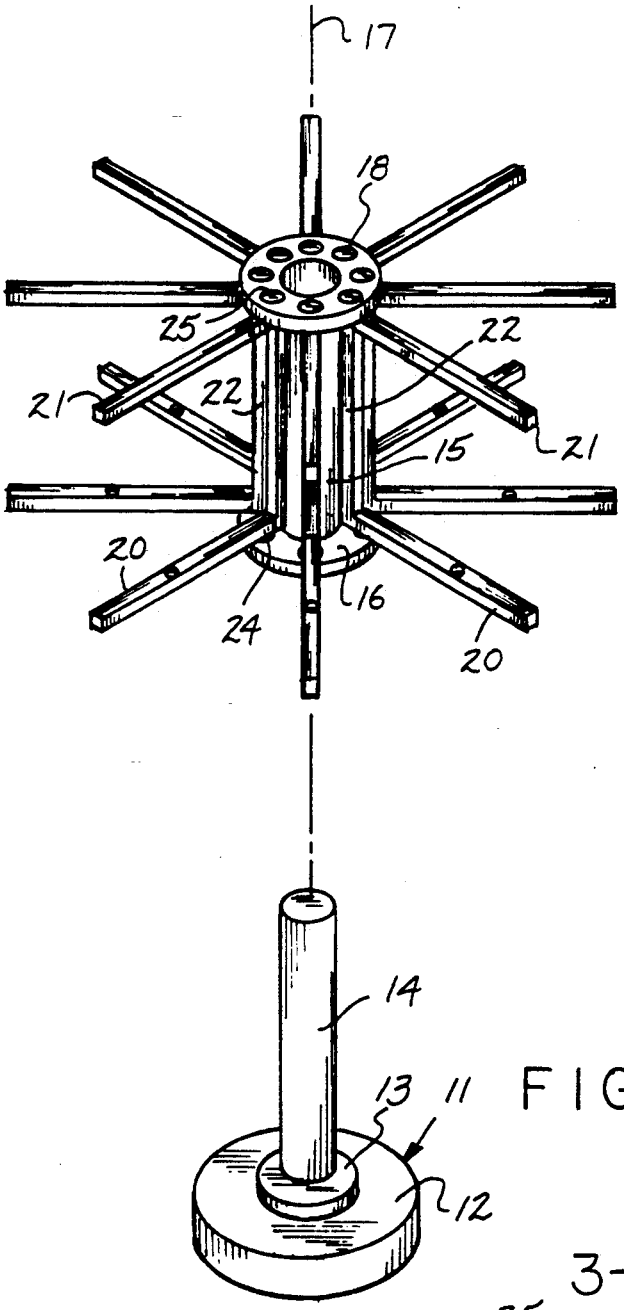
FIG. 1 is an isometric illustration of the housing structure arranged for mounting upon a shaft in rotatable arrangement.
Figure 2:
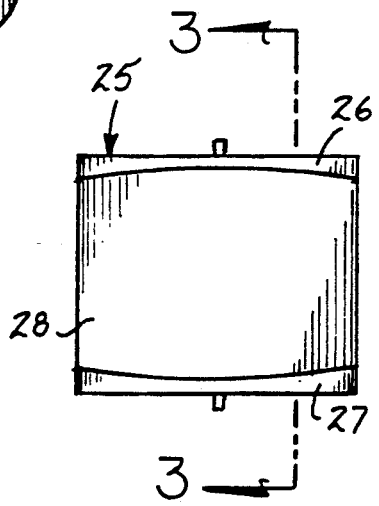
FIG. 2 is an orthographic view of an individual support frame.
Figure 3:
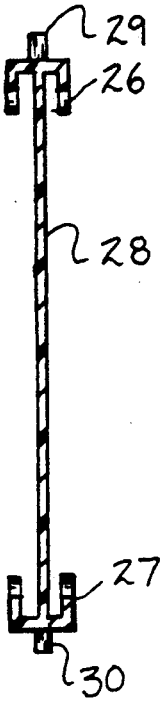
FIG. 3 is an orthographic view, taken along the lines 3—3 of FIG. 2 in the direction indicated by the arrows.
Figure 4:
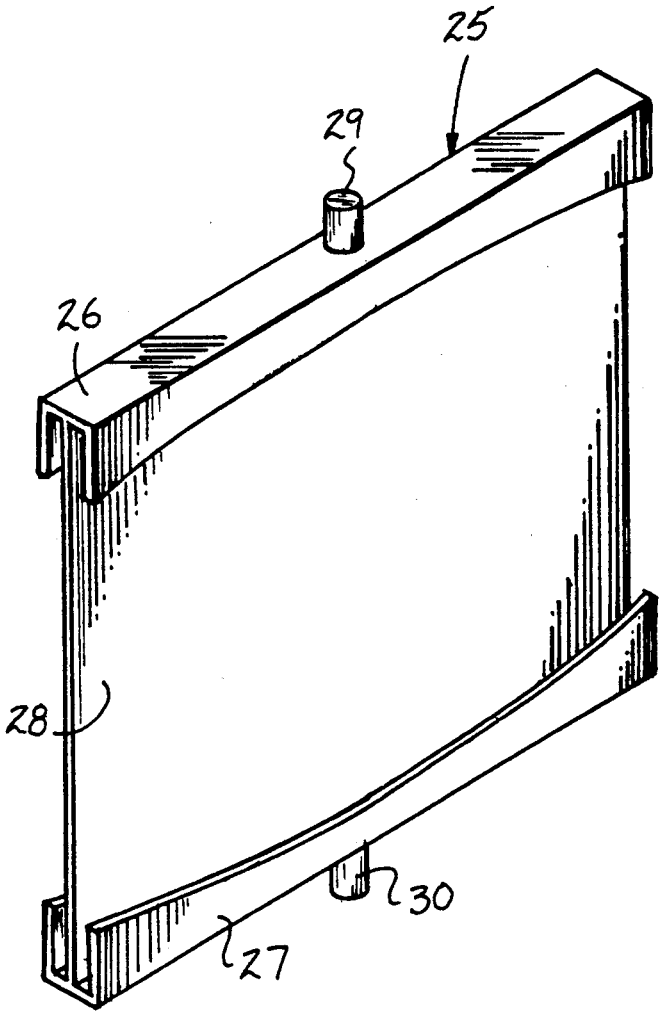
FIG. 4 is an isometric illustration of the support frame structure.
Figure 5:
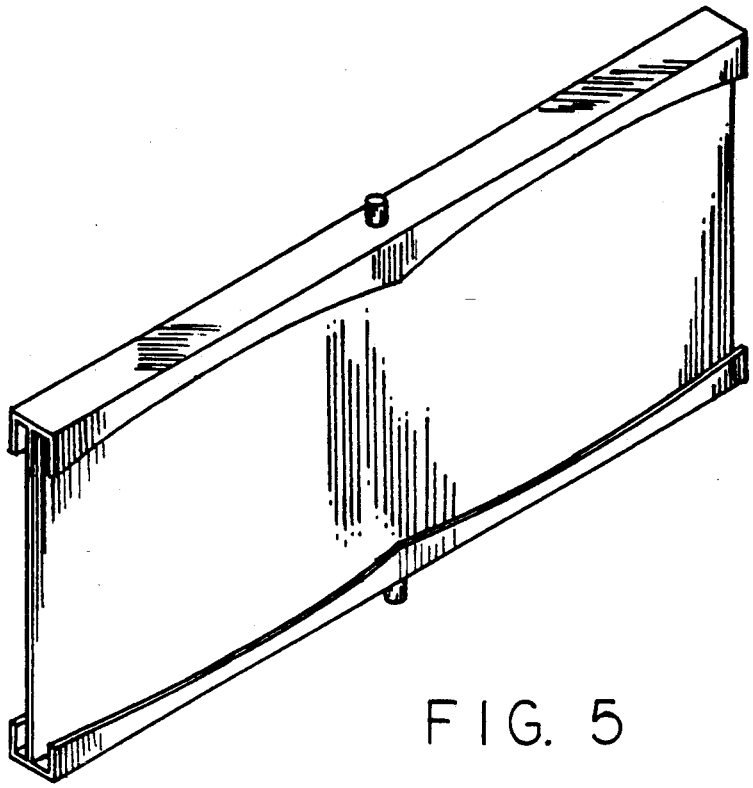
FIG. 5 and FIG. 6 are isometric illustrations of modified card display support frame structures.

With reference now to the drawings, and in particular to FIGS. 1 to 8 thereof, a new and improved card display arrangement embodying the principles and concepts of the present invention and generally designated by the reference numeral 10 will be described.

Figure 7:
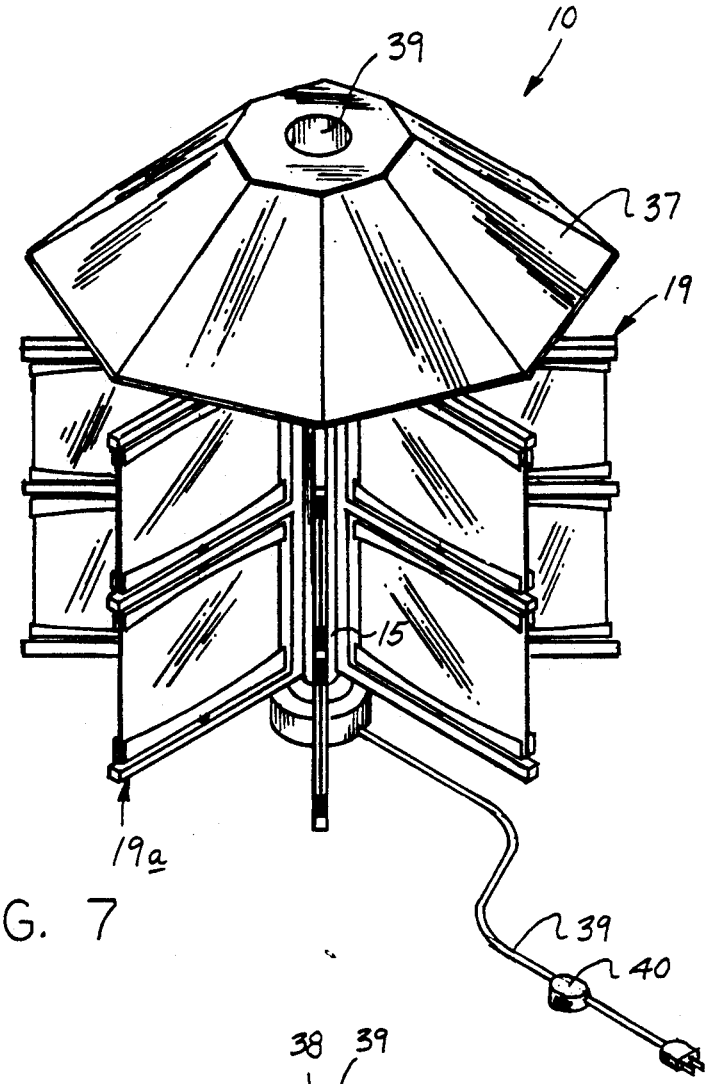
FIG. 7 is an isometric illustration of the invention including an illumination structure.

More specifically, the card display arrangement 10 of the instant invention essentially comprises, as indicated in FIG. 1, a base 11 having a base top wall 12, wherein a bearing collar 13 of a first diameter is mounted to the top wall 12, with a shaft 14 orthogonally and fixedly mounted to the bearing top wall through the collar 13 and configuring a shaft 14 of a second diameter less than the first diameter, whereupon a tubular housing 15 is provided receiving the shaft 14 in a rotatable relationship and accordingly, the tubular housing 15 is coaxially aligned relative to the shaft 14, as well as the bearing collar 13. The tubular housing 15 includes a housing first flange 16 spaced from and parallel a housing second flange 18 that are arranged orthogonally oriented relative to the housing axis 17 on opposed ends of the tubular housing 15, whereupon the first flange 16 is arranged to rotatably mount upon the housing top wall 12 employing the bearing collar 13. A plurality of U-shaped frame members 19 project radially and exteriorly of the tubular housing 15 in an annular array between the first and second flanges 16 and 18. Each of the U-shaped frame members 19 includes respective first and second frame legs 20 and 21 arranged in a parallel coextensive relationship orthogonally interconnected between the first and second flanges by a connecting web 22. A first leg axle 23 orthogonally mounted to the first frame leg 20 at the connecting web 22 is rotatably received within the first flange 16, while a second leg axle 24 orthogonally mounted to the second frame leg 21 at the connecting web 22 is rotatably received within the second flange 18, as illustrated in FIG. 7 for example. In this manner, each of the U-shaped frames are pivotally mounted to permit viewing access to a support frame 25 mounted intermediate each of the first and second frame legs 20 and 21.

Each of the support frames 25 includes respective first and second U-shaped channel legs 26 and 27 arranged in a parallel mirror image facing relationship relative to one another, having an intermediate planar web 28 orthogonally intersecting each of the first and second U-shaped channel legs 26 and 27 coextensively of the first and second U-shaped channel legs 26 and 27 permitting positioning of a card member (not shown) on each side of the intermediate web 28 received within the first and second U-shaped channel legs 26 and 27. A first channel leg axle 29 is orthogonally mounted intermediate the first channel leg 26, while a second channel leg axle 30 is mounted intermediate the second channel leg, with the first and second channel leg axles 29 and 30 arranged in a coaxially aligned relationship relative to one another rotatably received within the respective U-shaped support frames.

Figure 8:
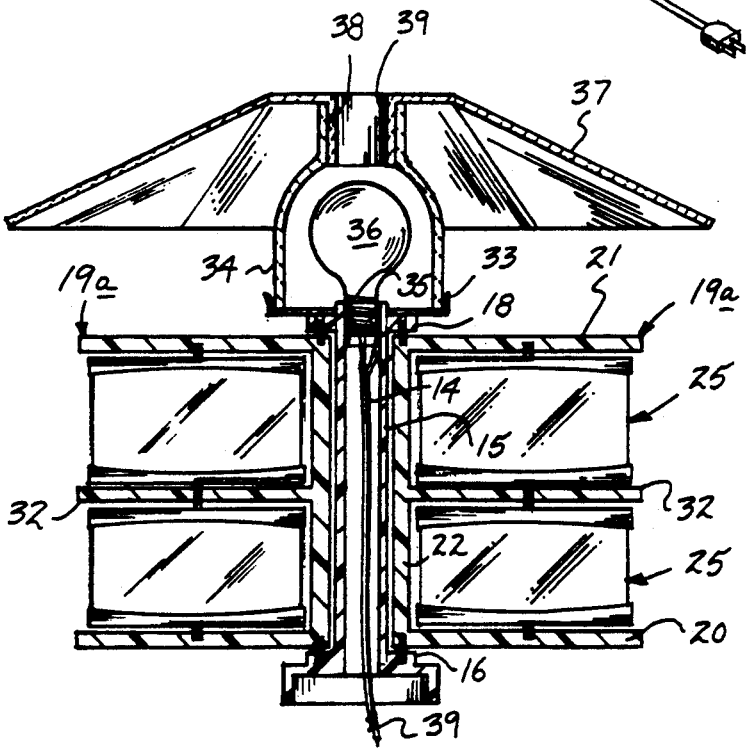
FIG. 8 is an orthographic cross-sectional illustration of the invention, as indicated in FIG. 7.

The FIGS. 7 and 8 indicates the use of an intermediate frame leg 32 orthogonally and medially intersecting the connecting web 22 arranged parallel, coextensive, and between the first and second frame legs 20 and 21. In this manner, each support frame 25 is mounted intermediate the first frame leg 20 and the intermediate frame leg 32 and between the intermediate frame leg 32 and the second frame leg 21, in a manner as indicated in FIG. 8.

Figure 6:
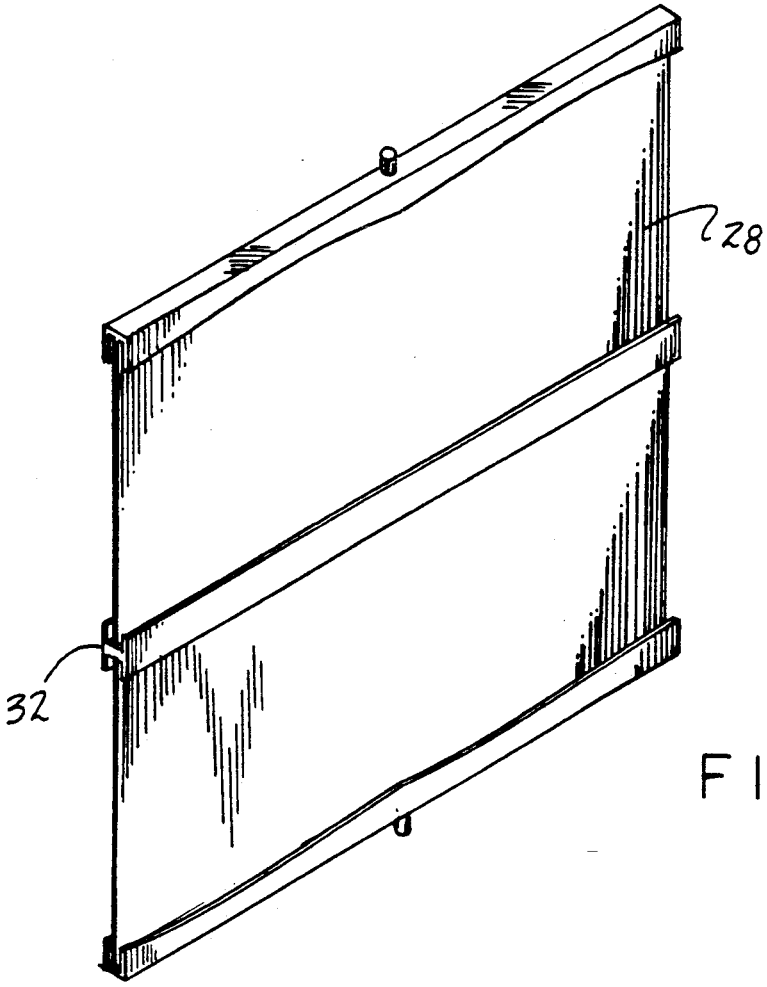

FIG. 6 indicates the use of an optional intermediate frame leg 32 of a generally I-shaped configuration to enhance the card carrying capacity of the support frame structure.

The FIGS. 7 and 8 further indicates the use of the shaft 14 of a tubular construction receiving a power supply line 39 having an electrical switch, in a manner as indicated in FIG. 7, wherein an electrical bulb socket 35 is mounted to an uppermost end of the tubular housing 15 directing the power supply line 39 through the shaft 14 to the electrical bulb socket 35. The bulb socket 35 includes an electrical bulb 36 operative through the power supply line 39. A shade plate 37 is provided mounted upon a translucent housing 34, that in turn is positioned upon a support plate 33 that extends radially beyond the housing 15 adjacent the electrical bulb socket 35. The translucent housing 34 includes a cylindrical housing opening 38 coaxially aligned with the housing 15, that in turn is coaxially aligned with the shaft 14. The cylindrical housing opening 38 is arranged to receive a shade plate cylindrical boss 39 therewithin providing for a chimney through the shade plate cylindrical boss that is of tubular construction to permit venting of the heat within the translucent housing 35, while simultaneously providing for reflected light onto the U-shaped frame members 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A card display arrangement, comprising, a base, the base including a base top wall, and a shaft fixedly and orthogonally mounted to the base top wall, and a tubular housing, the tubular housing including a housing first end and a housing second end, and the tubular housing symmetrically oriented about a housing axis, with the tubular housing having a first flange fixedly mounted to the housing first end and a second flange mounted to the housing at the housing second end, with the first flange and second flange arranged in a parallel relationship, and a plurality of U-shaped frame members pivotally mounted intermediate the first flange and the second flange orthogonally oriented between the first flange and second flange, with each of the U-shaped frame members having a first frame leg spaced from, parallel to, and coextensive with the second frame leg, and a connecting web orthogonally oriented between the first frame leg and the second frame leg, and a first leg axle fixedly mounted to the first frame leg in adjacency to the connecting web pivotally directed through the first flange, and a second leg axle mounted to the second frame leg coaxially aligned with the first leg axle, and the second leg axle positioned to the second frame leg in adjacency to the connecting web and pivotally directed through the second flange, and a support frame means arranged for supporting at least one card member for pivotal mounting between the first frame leg and the second frame leg.

2. A card display arrangement as set forth in claim 1 wherein the support frame means includes a first U-shaped channel leg and a second U-shaped channel leg, wherein the first U-shaped channel leg and the second U-shaped channel leg are arranged in a mirror image coextensive and facing relationship relative to one another, and an intermediate web extending orthogonally and rigidly between the first U-shaped channel leg and the second U-shaped channel leg, the intermediate web having a first side and a second side arranged to accommodate a card member on the first side and the second side between the first U-shaped channel leg and the second U-shaped channel leg, and a first channel leg axle fixedly and orthogonally mounted to the first U-shaped channel leg, and a second channel leg axle fixedly and orthogonally mounted to the second U-shaped channel leg, with the first channel leg axle and the second channel leg axle arranged in a coaxially aligned relationship relative to one another, and the first channel leg axle is arranged for pivotal mounting and received within the first frame leg, and the second channel leg axle pivotally mounted and received within the second frame leg.

3. A card display arrangement as set forth in claim 2 wherein the shaft is of a tubular construction and coaxially aligned and rotatably mounting the tubular housing thereabout, with the first flange arranged for rotative mounting relative to the base top wall, and a support plate fixedly and orthogonally mounted to the tubular housing in adjacency to the second flange, and a translucent housing mounted upon the support plate, and an electrical bulb socket mounted within the tubular housing within and intermediate the support plate, and an electrical supply line directed in electrical communication with the electrical bulb socket, and a shade plate, the shade plate including a shade plate cylindrical boss, and the translucent housing having a cylindrical housing opening receiving the shade plate cylindrical boss therethrough, with the shade plate cylindrical boss, the cylindrical housing opening, the tubular housing, and the shaft coaxially aligned relative to one another.

* * * * *